US007243824B2

(12) United States Patent
Tabata

(10) Patent No.: US 7,243,824 B2
(45) Date of Patent: Jul. 17, 2007

(54) HOLDER FOR A PORTABLE WIRELESS INSTRUMENT

(75) Inventor: Yasuji Tabata, Kakegawa (JP)

(73) Assignee: Tabata Zoen Kensetsu Kabushiki Kaisha (JP)

( * ) Notice: Subject to any disclaimer, the term of this patent is extended or adjusted under 35 U.S.C. 154(b) by 387 days.

(21) Appl. No.: 10/680,906

(22) Filed: Oct. 8, 2003

(65) Prior Publication Data

US 2004/0094584 A1 May 20, 2004

(30) Foreign Application Priority Data

Oct. 8, 2002 (JP) ..... 2002-294760

(51) Int. Cl.
*A45F 5/00* (2006.01)

(52) U.S. Cl. ..... 224/222; 224/267; 224/930

(58) Field of Classification Search ..... 224/221, 224/219, 603, 218, 222, 929, 930, 624, 660, 224/661, 662, 183, 267; 601/71, 79, 74
See application file for complete search history.

(56) References Cited

U.S. PATENT DOCUMENTS 3,710,784 A * 1/1973 Taylor ..... 601/18
4,101,861 A * 7/1978 Jenne ..... 337/368
4,135,653 A * 1/1979 Sieloff ..... 224/222
4,500,019 A * 2/1985 Curley, Jr. ..... 224/222
4,754,901 A * 7/1988 Villanueva et al. ..... 224/418
4,771,927 A * 9/1988 Ventura ..... 224/666
4,798,539 A * 1/1989 Henry et al. ..... 434/319
5,257,729 A * 11/1993 Silvernail ..... 224/219
5,327,886 A * 7/1994 Chiu ..... 607/96
5,749,838 A * 5/1998 Kline ..... 601/71
6,478,205 B1 * 11/2002 Fujihashi ..... 224/675
6,504,928 B1 * 1/2003 Toyooka ..... 379/433.01
6,550,655 B2 * 4/2003 Warner ..... 224/575
6,880,737 B2 * 4/2005 Bauer ..... 224/246

(Continued)

FOREIGN PATENT DOCUMENTS

JP 09331160 A * 12/1997

(Continued)

OTHER PUBLICATIONS

Pending U.S. Appl. No. 29/187,645, filed Aug. 2003, Yasuji Tabata.

(Continued)

*Primary Examiner*—Nathan J. Newhouse
*Assistant Examiner*—Justin M. Larson
(74) *Attorney, Agent, or Firm*—Harness, Dickey & Pierce, P.L.C.

(57) ABSTRACT

A holder for a portable wireless instrument has a pocket portion to contain the portable wireless instrument. The wireless instrument has a vibration function announcing an incoming call. A band portion fastens the pocket portion on an arm of a wearer. A vibration transmitting member is arranged on the rear portion. Both sides of the vibration transmitting member project from the inside and the outside of the rear portion of pocket. Thus, the vibration transmitting member contacts the holder for a portable wireless instrument and the arm of a wearer. Vibration of the portable wireless instrument is transmitted to the arm of a wearer of the portable wireless instrument via the vibration transmitting member.

6 Claims, 5 Drawing Sheets

U.S. PATENT DOCUMENTS

| | | | | |
|---|---|---|---|---|
| 6,934,517 | B2 * | 8/2005 | Fujihashi | 455/90.1 |
| 2003/0222109 | A1 * | 12/2003 | Weiss | 224/222 |

FOREIGN PATENT DOCUMENTS

| | | | |
|---|---|---|---|
| JP | 10-210120 | | 8/1998 |
| JP | 2001-161424 | | 6/2001 |
| JP | 2002125282 | A * | 4/2002 |
| JP | 2002125282 | A * | 4/2002 |
| JP | 2003087864 | A * | 3/2003 |
| JP | 2003204810 | A * | 7/2003 |

OTHER PUBLICATIONS

Pending U.S. Appl. No. 29/187,636, filed Aug. 2003, Yasuji Tabata.
Pending U.S. Appl. No. 29/187,637, filed Aug. 2003, Yasuji Tabata.

* cited by examiner

HOLDER FOR A PORTABLE WIRELESS INSTRUMENT

This application claims priority to Japanese Patent Application No. 2002-294760 filed Oct. 8, 2002, which application is herein expressly incorporated by reference.

FIELD OF THE INVENTION

The present invention relates to a holder for a portable wireless instrument (hereinafter sometimes referred to simply as holder) such as a cellular phone, a PHP, a transceiver, etc.

BACKGROUND OF THE INVENTION

Holders, more particularly a holder for wearing a portable wireless instrument on an arm of a wearer, are described for example in Japanese Laid-open Patent Publication No. 161424/2001 and Japanese Registered Design No. 1143941. The holder has a pocket (pouch) portion to contain the portable wireless instrument (e.g. a cellular phone) and a band portion (a fastening belt) adapted to be fastened on the arm of a wearer. The holder is made of cloth or leather. It has become a mainstream that the portable wireless instrument inform the recipient of an incoming call via vibration generated by a vibrator built in the portable wireless instrument. The prevention of a ringing sound provides consideration to surrounding persons.

SUMMARY OF THE INVENTION

However, in the holders of the prior art, a cloth or leather pocket portion is between the portable wireless instrument and the arm of its wearer. The pocket portion absorbs the vibration generated by a vibrator and thus obstructs the propagation of the calling vibration.

SUMMARY OF THE INVENTION

It is, therefore, an object of the present invention to provide a holder for a portable wireless instrument which can positively transmit the vibration of the portable wireless instrument to the arm of a wearer. In turn, this positively informs him (or her) of an incoming call.

According to a holder of the present invention, a vibration transmitting member is arranged on the rear portion of the pocket portion. Both sides of the vibration transmitting member project from the inside and the outside of the rear portion of the pocket. Thus, the vibration transmitting member contacts the holder for a portable wireless instrument and the arm of a wearer. Accordingly, this enables the vibration of the portable wireless instrument to be transmitted to the arm of a wearer of the portable wireless instrument.

The vibration transmitting member is a sheet material with a portable wireless instrument contacting surface and an arm contacting surface. The vibration transmitting member has recesses or projections on at least one of the portable wireless instrument contacting surface and the arm contacting surface. Alternatively, the vibration transmitting member has a plurality of spherical members. Further, the vibration transmitting member may include bar members. The hardness of the vibration transmitting member is different between the side contacting the portable wireless instrument and the side contacting the arm of a wearer.

The vibration transmitting member may have an electromagnetic wave shielding function. In this case, the electromagnetic wave means radiation energy caused by vibration of an electric or magnetic field. The electromagnetic wave shielding function intercepts the propagation of the electromagnetic wave.

The vibration transmitting member may have an antibacterial function. In this case, the antibacterial function suppresses the multiplication of bacteria.

The vibration transmitting member may have an antistatic function. In this case, the antistatic function suppresses the generation of static electricity.

BRIEF DESCRIPTION OF THE DRAWINGS

Additional advantages and features of the present invention will become apparent from the subsequent description and the appended claims, taken in conjunction with the accompanying drawings, wherein:

DETAILED DESCRIPTION OF THE PREFERRED EMBODIMENTS

The following description of the preferred embodiment(s) is merely exemplary in nature and is in no way intended to limit the invention, its application, or uses.

Figure 1:
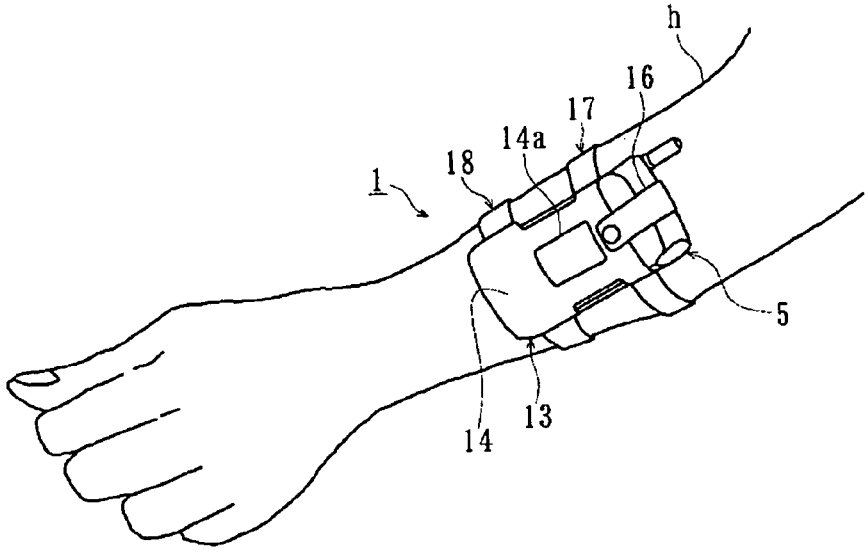
FIG. 1 is a perspective view of an example of a holder for a portable wireless instrument of the present invention.
Figure 2:
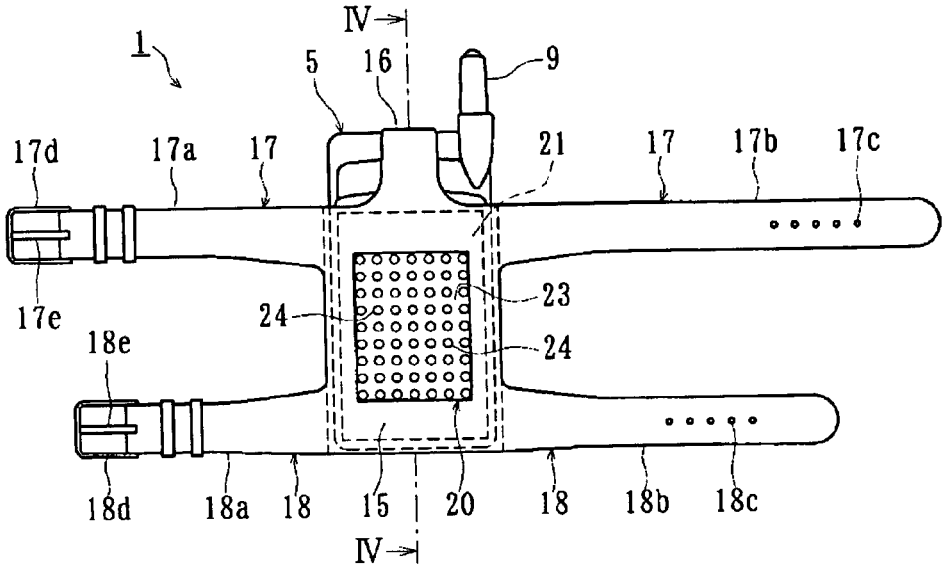
FIG. 2 is a rear elevation view of the holder for the portable wireless instrument of FIG. 1.
Figure 3:
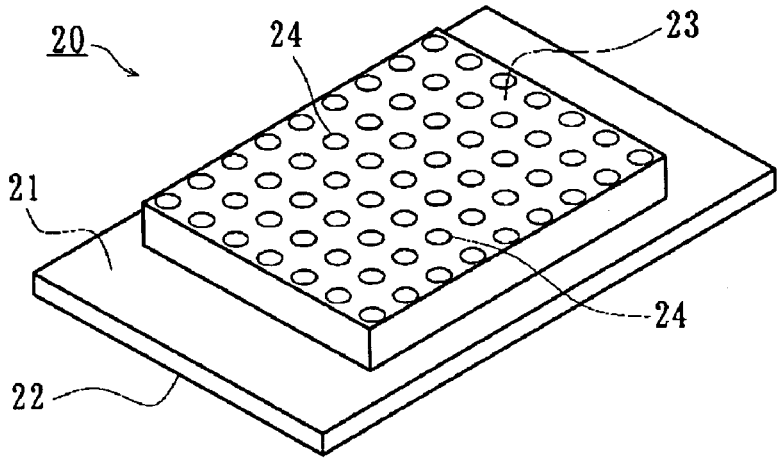
FIG. 3 is a perspective view of a vibration transmitting member of the holder for the portable wireless instrument of FIG. 2.
Figure 4:
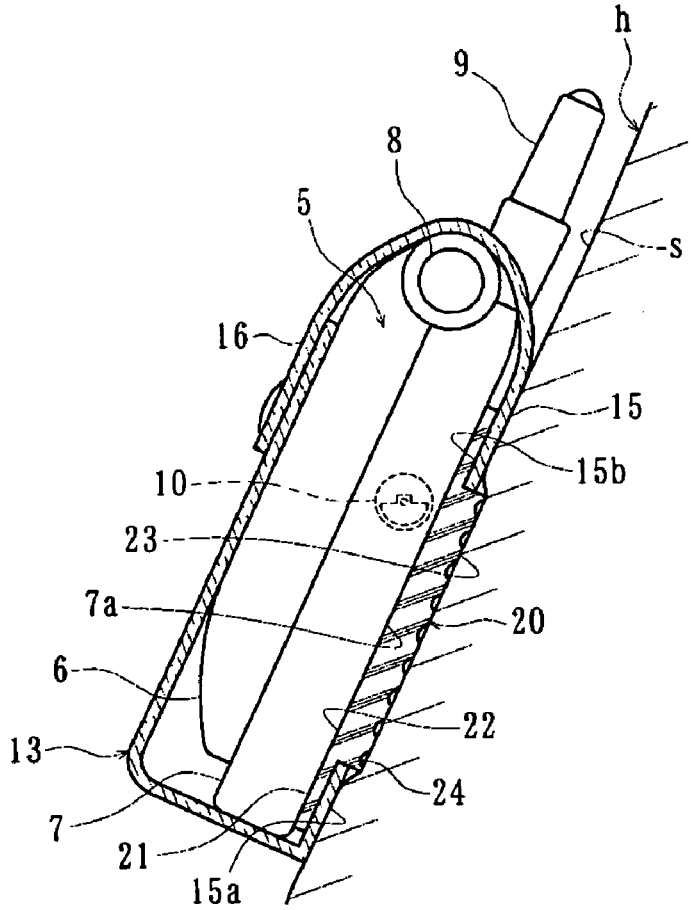
FIG. 4 is a cross-sectional view of the holder for the portable wireless instrument of FIG. 2 taken along a line IV—IV thereof.

A preferable embodiment of the present invention will be described with reference to the accompanying drawings. FIG. 1 is a perspective view of a first embodiment of a holder for a portable wireless instrument of the present invention. FIG. 2 is a rear elevation view of the holder for the portable wireless instrument of FIG. FIG. 3 is a perspective view of a vibration transmitting member of the holder for the portable wireless instrument of FIG. 2. FIG. 4 is a cross-sectional view of the holder for the portable wireless instrument of FIG. 2 taken along a line IV—IV.

A holder 1 for a portable wireless instrument (hereinafter referred to simply as holder 1) is a holder for a portable wireless instrument such as a cellular phone, a PHP, a transceiver, etc. The transceiver includes a wide range of instruments for example business wireless instruments such as a MCA (Multi-Channel Access radio system) and portable wireless instruments such as so-called a handy type instrument for domestic use. Although the illustrated embodiment is described as a example of the portable wireless instrument using a cellular phone 5, the holder 1 of the present invention can be applied to other types of the portable wireless instrument.

The holder 1 has a pocket portion 13 with a pouch configuration to contain the cellular phone 5. Band portions 17 and 18 are connected to the pocket portion 13 to fasten the pocket portion 13 on an arm "h". A window 14*a* is formed nearly at the center of a front portion 14 of the pocket portion. The window 14*a* exposes an indicator of the phone 5 when the phone 5 is contained in the pocket portion 13. A closing belt 16 prevents the phone 5 from jumping out from the pocket portion 13. The closing belt 16 extends from a rear portion 15 to the front portion 14 to cover a portion of the phone 5 projecting from the pocket portion 13. The illustrated cellular phone 5 is a foldable type having an upper casing 6 and a lower casing 7 connected together via a hinge 8. An antenna 9 projects from the top end of the lower casing 7. A vibrator 10 to inform a wearer of an incoming call is arranged within the lower casing. Of course, the phone 5 may be a flat plate type other than the foldable type.

The band portions 17 and 18 are arranged on both sides of the rear portion 15 of the pocket portion 13. As shown in FIG. 2, the band portions 17 and 18 are two pairs of parallel band portions. Each pair has bands 17*a* and 17*b* and bands 18*a* and 18*b* extend outward from the pocket portion 13. Buckles 17*d* and 18*d* are provided on the ends of bands 17*a* and 18*a*. Each buckle 17*d* (and 18*d*) has a needle 17*e* (and 18*e*) to engage an aperture 17*c* (and 18*c*), respectively, arranged near the end of the band 17*b* (and 18*b*). The buckles and the apertures may be replaced by any other types of fasteners, for example, a hook and loop fastener. The band portions 17 and 18 may be formed by one pair type band, and alternatively a cylindrical fastener where an arm can be inserted. The pocket portion 13 and the band portions 17 and 18 can be made from any sheet material such as leather, cloth or plastic sheet.

A plate-shaped vibration transmitting portion 20 is arranged at the rear portion 15 of the pocket portion 13. One side of the vibration transmitting portion 20 forms a wireless instrument contacting surface 22. The other side forms an arm contacting surface 23. A flange portion 21 is formed at the ends of the arm contacting surface 23 by removing a portion of material. The flange portion 21 forms a projecting portion at the side contacting an arm as shown in FIG. 4. A plurality of recesses 24 are formed on the arm contacting surface. The vibration transmitting member 20 can be made of any material such as metal, plastic etc. enabling efficient transmission of vibration of the vibrator 10 of the phone 5.

The vibration transmitting member 20 is passed through a front surface 15*a* and a rear surface 15*b* of the rear portion 15 of the pocket portion 13. The flange portion 21 is adhered to the rear surface 15*b*. The arm contacting surface 23 of the vibration transmitting member 20 projects from the front surface 15*a* of the rear portion 15. The wireless instrument contacting surface 22 projects from the rear surface 15*b* of the rear portion 15 of the pocket portion 13. In this case, the vibration transmitting member 20 may be secured in the pocket portion 13 by any other method, such as sutures.

The method for using the holder 1 will be described. The cellular phone 5 is folded and inserted in the pocket portion 13 of the holder 1. The closing belt 16 is wound around the exposed top portion of the phone 5 to prevent the phone 5 from coming out of the pocket portion 13. As shown in FIG. 1, the rear portion 15 is then contacted with a user's skin. The band portions 17 and 18 are wound around the arm "h" and inserted in the buckles 17*d* and 18*d*. The needles 17*e* and 18*e* are inserted in the apertures 17*c* and 18*c*. Thus, the holder 1 is completely fastened on the arm "h". Under this condition, the wireless instrument contacting surface 22 of the vibration transmitting member 20 intimately contacts with a back surface 7*a* of the lower housing 7 of the cellular phone 5. The arm contacting surface 23 of the vibration transmitting member 20 intimately contacts with the wearer's skin. The wearer can await an incoming call under this condition.

When the phone 5 receives a call, the vibrator 10 is operated to vibrate the casing of the phone 5. The vibration of the phone 5 is transmitted from the back surface 7*a* to the wireless instrument contacting surface 22 of the vibration transmitting member 20 via the lower casing 7. Thus, the vibration transmitting member 20 is vibrated. This vibration is further transmitted from the arm contacting surface 23 to the skin. The wearer knows a call, via the vibration of the wearer's skin, has been received and transmitted by the vibration transmitting member 20.

As can be seen from the present invention, the wearer can positively know that an incoming call of the cellular phone 5, via the vibration of the skin of the arm "h", has been transmitted by the vibration transmitting member 20.

According to the present invention, the vibration transmitting member 20 has a plate-shaped configuration. Thus, the vibration transmitting member contacts both the cellular phone 5 and the arm "h" via a large contacting area. This enables the vibration of the cellular phone 5 to be positively transmitted to the wearer of the phone 5. The plurality of recesses 24 formed on the arm contacting surface 23 of the vibration transmitting member 20 suppresses slippage relative to the wearer's skin. Thus, it positively transmits the vibration of the cellular phone 5 to the wearer.

Figure 5:
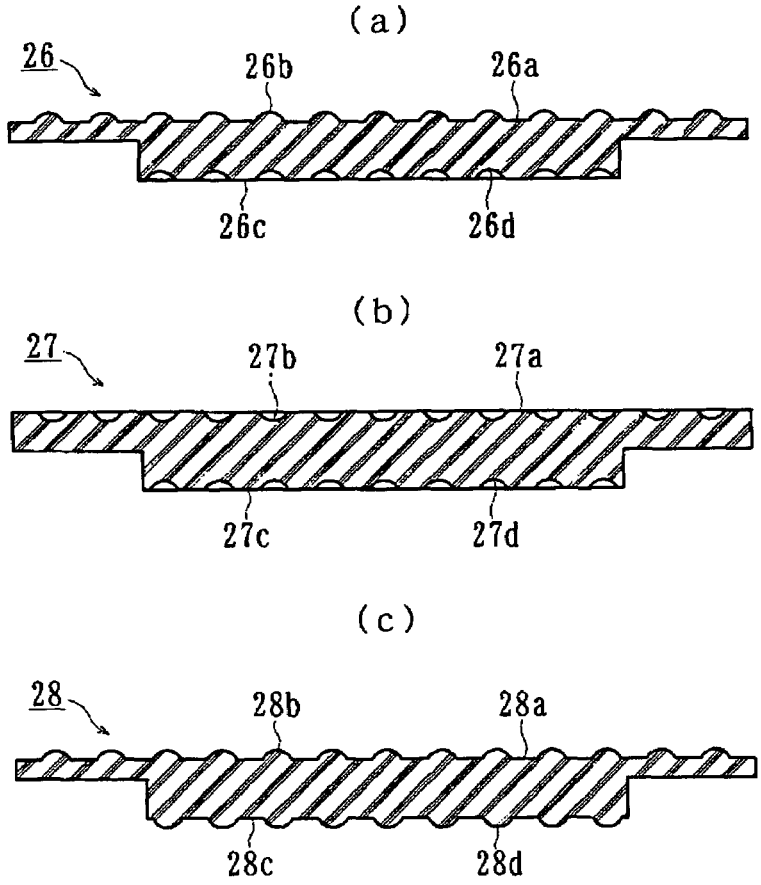
FIGS. 5 (*a*)–(*c*) are cross-sectional views showing other configurations of the vibration transmitting member of the holder for the portable wireless instrument of FIG. 2.

The conditions such as number, configuration, arrangement etc. of the recesses and/or projections formed on the wireless instrument contacting surface 22 and the arm contacting surface 23 can be determined on the basis of the configuration or the size of the portable wireless instrument and the condition of the arm. Several examples can be contemplated as shown in FIG. 5. A vibration transmitting member 26 of FIG. 5 (*a*) has a plurality of projections 26*b* formed on the wireless instrument contacting surface 26*a*. A plurality of recesses 26*d* are formed on the arm contacting surface 26*c*. A vibration transmitting member 27 of FIG. 5 (*b*) has a plurality of recesses 27*b* and 27*d* formed on both the wireless instrument contacting surface 27*a* and the arm contacting surface 27*c*. A vibration transmitting member 28 of FIG. 5 (*c*) has a plurality of projections 28*b* and 28*d* formed on both the wireless instrument contacting surface 28*a* and the arm contacting surface 28*c*. Alternatively, it is possible to provide projections or recesses on either one of the wireless instrument contacting surface or the arm contacting surface and to keep the other one of the wireless instrument contacting surface or the arm contacting surface flat.

Figure 6:
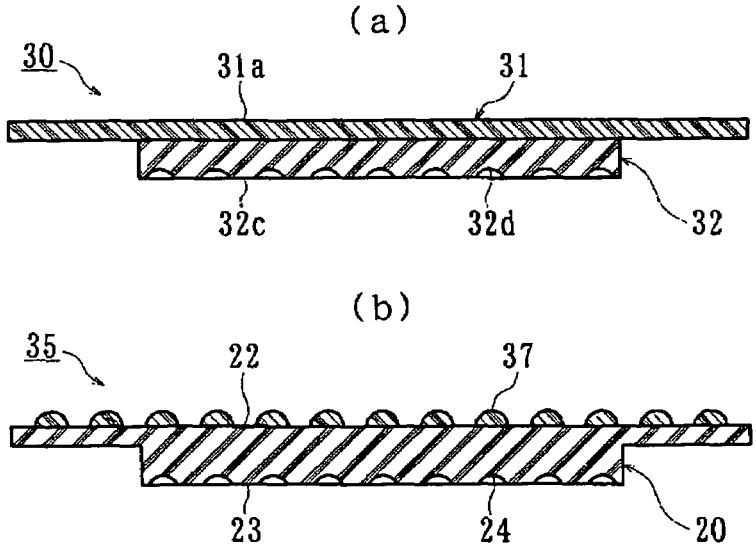
FIGS. 6 (*a*) and (*b*) are cross-sectional views showing further configurations of the vibration transmitting member of the holder for the portable wireless instrument of FIG. 2.

As shown in FIG. 6, it is possible to form a vibration transmitting member 30 from two members of different size. Each member forms the wireless instrument contacting member 31 and the arm contacting member 32. In this vibration transmitting member 30, it is possible to more positively transmit the vibration of the portable wireless instrument to the wearer by using materials having different hardness to form the wireless instrument contacting member 31 and the arm contacting member 32. Thus, by selecting an optimum hardness, it is possible to enhance vibration transmission of the portable wireless instrument to the wearer. In this case, the wireless instrument contacting member 31 and the arm contacting member 32 may be formed by metal and/or plastic each having a different hardness. In addition, as shown in FIG. 6 (*b*), it is possible to adhere a plurality of semi-spherical projections 37 on the wireless instrument contacting surface 22 of the vibration transmitting member 20. The hardness of the semi-spherical projections 37 may be differentiated from that of the vibration transmitting member 20.

Figure 7:
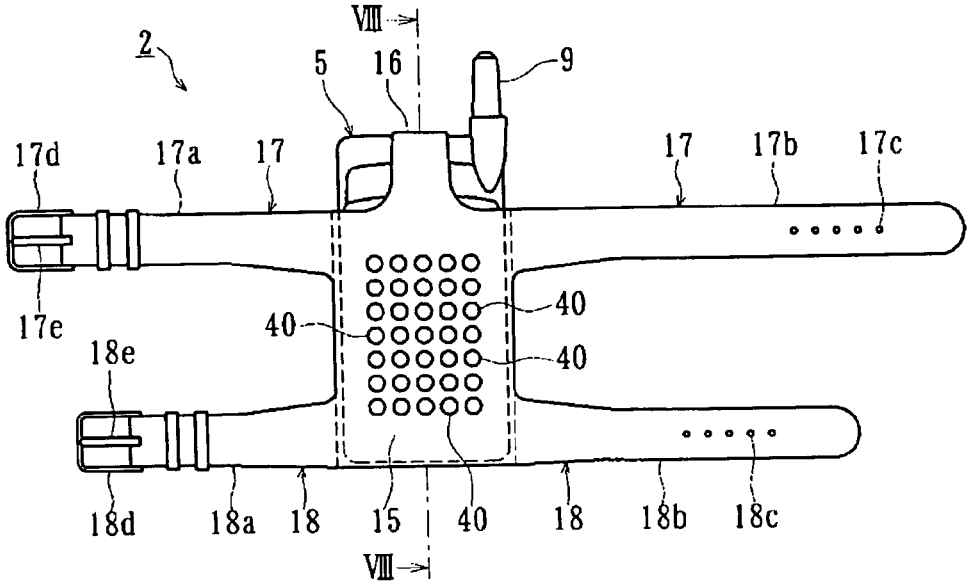
FIG. 7 is a rear elevation view of a holder for the portable wireless instrument where the vibration transmitting member has a plurality of spherical members.
Figure 8:
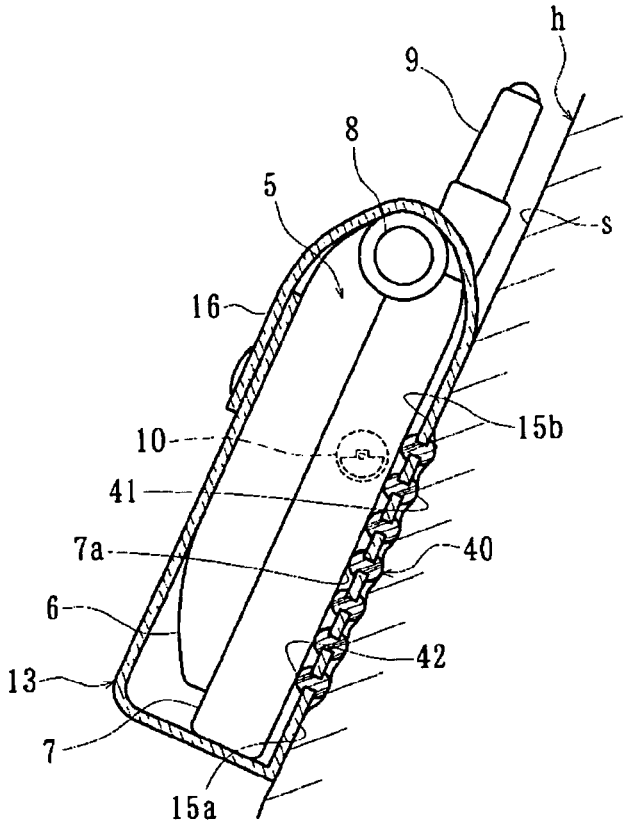
FIG. 8 is a cross-sectional view of the holder for the portable wireless instrument of FIG. 7 taken along a line VIII—VIII thereof.

The vibration transmitting member 20 may be any suitable configuration other than the plate-shaped configuration as long as it transmits the vibration of the portable wireless instrument to the wearer. For example, spherical members or bar members shown in FIGS. 7–10 may be adopted. Vibration transmitting members 40 shown in FIGS. 7 and 8 are spherical members. The spherical members pass through the front and rear surfaces 15*a* and 15*b* of the rear portion 15 of the pocket portion 13 of the holder 2. Ends 41 of the spherical members 40 project from the front surface 15*a* of the rear portion 15. Ends 42 of the spherical members 40 project from the rear surface 15*b* of the rear portion 15. Thus, vibration of the phones from an incoming call is transmitted to the arm "h" of the wearer via vibrating ends 42 contacting the phone 5 and transmitting the vibration to ends 41 contacting the arm "h". The ends 41 contact the arm "h" by slightly biting into the skin. Thus, the vibration of the phone 5 can be more positively transmitted to its wearer. This increases the vibration transmission over flat contacting surfaces.

Figure 9:
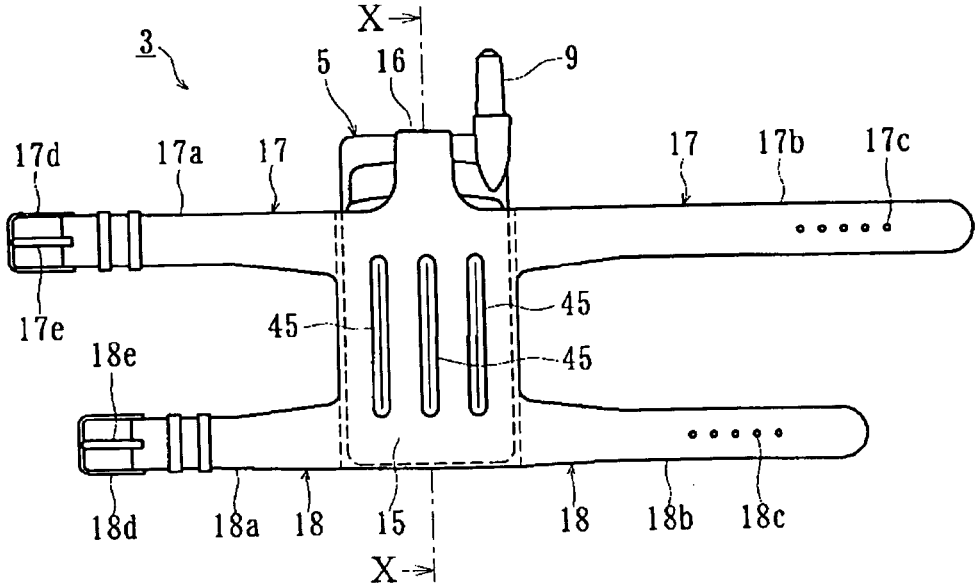
FIG. 9 is a rear elevation view of a holder for the portable wireless instrument where the vibration transmitting member is a plurality of bar members.
Figure 10:
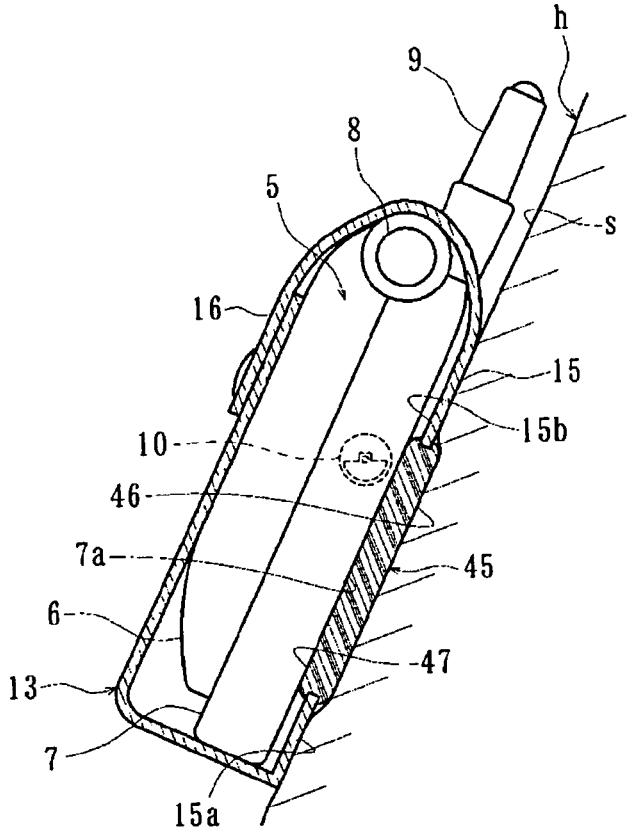
FIG. 10 is a cross-sectional view of FIG. 9 taken along line X—X thereof.

Vibration transmitting members 45 shown in FIGS. 9 and 10 are bar members. The bar members 45 pass through the front and rear surfaces 15*a* and 15*b* of the rear portion 15 of the pocket portion 13 of the holder 2. Linearly extending ends 46 of the bar members 45 project from the front surface 15*a* of the rear portion 15. Linearly extending ends 47 of the bar members 45 also project from the rear surface 15*b* of the rear portion 15. The vibration created from an incoming call is transmitted to the arm "h" of the wearer via vibrating the ends 47 contacting the phone and transmitting the vibration to ends 46 contacting the arm "h". The ends 46 contact the arm "h" by slightly biting into the skin. Thus, the vibration of the phone 5 can be more positively transmitted to its wearer. This increases the vibration transmission over flat contacting surfaces.

Examples of metal materials forming the vibration transmitting member include aluminum, titanium, iron, copper, gold, silver platinum, nickel, zinc, tin, alloys of these metals, and alloys of them and magnesium, cobalt, vanadium. Ceramic or plastics may be also adopted. Examples of plastic materials include silicone resin, styrene/butadiene resin, butadiene resin, isoprene resin, chloroprene resin, urethane resin, nitrile hydroxide resin, acrylic resin, abichlorohydrin resin, propylene oxide resin, ethylene acrylic resin, thermoplastic elastomer (styrene family, olefin family, urethane family, polyester family, polyamide family, polybutadiene family, vinyl chloride family, fluorine family etc.).

Shielding of electromagnetic waves can be obtained by using materials to make the vibration transmitting member, metals such as copper, silver, tin, etc. or ceramic or plastic including these metals, silicon nitride or silicon carbide. In this case, the electromagnetic wave is radiation energy caused by vibration of electric or magnetic field. The electromagnetic wave shielding is a function of intercepting the propagation of the electromagnetic wave. Sheet members having the electromagnetic wave shielding function may be adhered to the vibration transmitting member. Vibration transmitting members with the electromagnetic wave shielding function reduces the influence of the electromagnetic wave generated by a cellular phone 5 to the human body. Other methods can be adopted to apply the electromagnetic wave shielding function to the vibration transmitting member.

The vibration transmitting member can have an antibacterial function by using materials mentioned above (e.g. metals such as gold, silver, white silver, zinc, titanium oxide, and ceramic or plastic including alloys of these metals) to make the vibration transmitting member. In this case, the antibacterial function suppresses the multiplication of bacteria. Sheet members with the antibacterial function may be adhered to the vibration transmitting member or antibacterial agent may be applied to the vibration transmitting member. Vibration transmitting members with the antibacterial function reduces the influence of bacteria on the skin of the human body. Other methods can be adopted to apply the antibacterial function to the vibration transmitting member.

The vibration transmitting member can also have an antistatic function. Conductive resin or resin including surface-active agents may be used to make the vibration transmitting member. In this case, the antistatic function suppresses the generation of static electricity. Sheet members with the antistatic function may be adhered to the vibration transmitting member. Antistatic agents may be applied to the vibration transmitting member. Vibration transmitting members with the antistatic function reduces the generation of static electricity and thus reduces discomfort caused by the static electricity. Other methods can be adopted to apply the antistatic function to the vibration transmitting member.

According to the present invention, it is possible to positively transmit vibration of a portable wireless instrument to the arm of its wearer via the vibration transmitting member. Thus, the wearer can easily identify incoming calls of the portable wireless instrument.

According to the invention, the vibration transmitting member has wide area contacting surfaces. Thus, it is possible to positively transmit vibration of the portable wireless instrument to the wearer's arm via the vibration transmitting member. Thus, the wearer can easily identify incoming calls of the portable wireless instrument.

According to the invention, slippage is suppressed between the vibration transmitting member and skin. Thus, it is possible to positively transmit vibration of the portable wireless instrument to the wearer's arm via the vibration transmitting member. Thus, the wearer can easily identify incoming calls from the portable wireless instrument.

According to the invention, spherical members slightly bite into the skin of wearer. Thus, it is possible to positively transmit vibration of the portable wireless instrument to the arm of its wearer, via the vibration transmitting member. Thus, the wearer can easily identify incoming calls of the portable wireless instrument.

According to the invention, the bar members slightly bite into the skin of the wearer. Thus, it is possible to positively transmit vibration of the portable wireless instrument to the arm of its wearer via the vibration transmitting member. Thus, the wearer can easily identify incoming calls of the portable wireless instrument.

According to the invention, the vibration transmitting member can have a different hardness at the wireless instrument contacting side and at the arm contacting side. The hardness is selected to enhance vibration transmission between the wireless instrument contacting side and the arm contacting side. Thus, it is possible to positively transmit vibration of the portable wireless instrument to the arm of its wearer, via the vibration transmitting member. Thus, the wearer can easily identify incoming calls of the portable wireless instrument.

According to the invention, the vibration transmitting member can shield electromagnetic waves. Thus, it is possible to reduce the influence of electromagnetic wave on the human body.

According to the invention, the vibration transmitting member can have an antibacterial function. Thus, it is possible to keep the wearer's skin clean.

According to the invention, the vibration transmitting member has an antistatic function. Thus, it is possible to suppress the generation of static electricity and maintain the wearer's comfort.

The present invention has been described with reference to the preferred embodiment. Obviously, modifications and alternations will occur to those of ordinary skill in the art upon reading and understanding the preceding detailed description. It is intended that the present invention be construed as including all such alternations and modifications insofar as they come within the scope of the appended claims or their equivalents.

What is claimed is:

1. A holder for a portable wireless instrument such as a cellular telephone comprising:

a pocket portion for containing a portable wireless instrument having a vibration function for announcing incoming calls, and a band portion for fastening the pocket portion on an arm of a wearer;

a vibration transmitting member arranged on a rear portion of the pocket portion, the vibration transmitting member having a first portion projecting into the pocket portion for contacting the portable wireless instrument and a second portion projecting outside of the rear portion of the pocket so that the second portion of the vibration transmitting member contacts an arm of a wearer; and vibration of the portable wireless instrument is transmitted to the arm of the wearer of the portable wireless instrument from said first portion to said second portion of said vibration transmitting member directly; and the vibration transmitting member has recesses or projections on the arm contacting surface which directly contacts the arm.

2. The holder for a portable wireless instrument of claim 1 wherein the vibration transmitting member is plate shaped wherein said first portion is a portable wireless instrument contacting surface and said second portion is an arm contacting surface.

3. The holder for a portable wireless instrument of claim 1 wherein the vibration transmitting member comprises a plurality of spherical members.

4. The holder for a portable wireless instrument of claim 1 wherein the vibration transmitting member provides an electromagnetic wave shielding function.

5. The holder for a portable wireless instrument of claim 1 wherein the vibration transmitting member provides an antibacterial function.

6. The holder for a portable wireless instrument of claim 1 wherein the vibration transmitting member provides an antistatic function.

* * * * *